US009835025B2

(12) United States Patent
Reed et al.

(10) Patent No.: US 9,835,025 B2
(45) Date of Patent: Dec. 5, 2017

(54) DOWNHOLE ASSEMBLY EMPLOYING WIRED DRILL PIPE

(71) Applicant: Schlumberger Technology Corporation, Sugar Land, TX (US)

(72) Inventors: Christopher Paul Reed, West University Place, TX (US); Steven Hough, Minchinhampton (GB); John Rasmus, Richmond, TX (US); David Kirk Conn, Houston, TX (US); Brian Oliver Clark, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 192 days.

(21) Appl. No.: 14/623,458

(22) Filed: Feb. 16, 2015

(65) Prior Publication Data

US 2016/0237811 A1 Aug. 18, 2016

(51) Int. Cl.

| | |
|---|---|
| ***E21B 47/00*** | (2012.01) |
| ***E21B 17/00*** | (2006.01) |
| ***E21B 47/12*** | (2012.01) |
| ***E21B 47/18*** | (2012.01) |

(52) U.S. Cl.

CPC ..... *E21B 47/122* (2013.01); *E21B 47/00* (2013.01); *E21B 47/12* (2013.01); *E21B 47/18* (2013.01); *E21B 17/003* (2013.01)

(58) Field of Classification Search

CPC ..... E21B 47/122; E21B 47/12; E21B 47/00; E21B 47/18; E21B 17/003

See application file for complete search history.

(56) References Cited

U.S. PATENT DOCUMENTS

| | | | | |
|---|---|---|---|---|
| 5,375,098 | A | 12/1994 | Malone et al. | |
| 6,206,108 | B1 | 3/2001 | MacDonald et al. | |
| 6,727,827 | B1 | 4/2004 | Edwards et al. | |
| 6,985,814 | B2 | 1/2006 | McElhinney | |
| 2005/0279532 | A1 | 12/2005 | Ballantyne et al. | |
| 2009/0143990 | A1 | 6/2009 | Kamata | |
| 2009/0251331 | A1 | 10/2009 | Wassermann et al. | |
| 2010/0328096 | A1* | 12/2010 | Hache | E21B 47/12 340/854.4 |
| 2011/0042072 | A1 | 2/2011 | Villegas et al. | |
| 2011/0074427 | A1 | 3/2011 | Wang et al. | |
| 2011/0102188 | A1 | 5/2011 | Mehta et al. | |

(Continued)

OTHER PUBLICATIONS

International Search Report and Written Opinion issued in related PCT application PCT/US2016/017639 dated May 25, 2016, 14 pages.

*Primary Examiner* — Brad Harcourt

(57) ABSTRACT

A system for drilling a subterranean wellbore includes a bottom hole assembly (BHA) coupled to a downhole end of a drill string. The BHA includes an electronic controller having a processor. The drill string includes downhole and uphole portions with the downhole portion made up of wired drill pipe and the uphole portion made up of non-wired drill pipe. The downhole portion further includes at least one downhole tool or sensor sub in communication with the BHA via the wired drill pipe communication link. Methods for making sensor measurements, downlinking data and/or commands to the BHA, and actuating a downhole tool make use of the system.

11 Claims, 2 Drawing Sheets

(56) References Cited

U.S. PATENT DOCUMENTS

| | | | |
|---|---|---|---|
| 2011/0238312 | A1 | 9/2011 | Seydoux et al. |
| 2011/0286308 | A1 | 11/2011 | Sugiura |
| 2011/0286309 | A1 | 11/2011 | Sugiura |
| 2013/0048380 | A1 | 2/2013 | Rasmus et al. |
| 2013/0220602 | A1 | 8/2013 | Patwa et al. |
| 2013/0341091 | A1 | 12/2013 | Sugiura |
| 2014/0036629 | A1 | 2/2014 | Sugiura |

* cited by examiner

DOWNHOLE ASSEMBLY EMPLOYING WIRED DRILL PIPE

CROSS REFERENCE TO RELATED APPLICATIONS

None.

FIELD OF THE INVENTION

Disclosed embodiments relate generally to downhole drilling operations and more particularly to a downhole assembly employing wired drill pipe.

BACKGROUND INFORMATION

During drilling operations, measurements of downhole conditions taken while drilling can provide valuable information that may be used by a drilling operator to improve efficiency and performance and minimize risk. Such measurements may include measurement while drilling (MWD) and logging while drilling (LWD) measurements to obtain information about the wellbore and the surrounding formations. Along string temperature and pressure measurements (ASM) may also be of value to a drilling operator. Such along string measurements may be utilized, for example, to compute interval densities along the length of the drill string as is disclosed in U.S. Patent Publication 2013/0048380, which is incorporated herein in its entirety.

While MWD, LWD, and ASM are used in downhole drilling operations, there is room for further development. For example, there is room for improved measurements as well as for improved communication between sensors deployed along a portion of the drill string and sensors in the bottom hole assembly (BHA).

SUMMARY

A system for drilling a subterranean wellbore includes a bottom hole assembly (BHA) coupled to a downhole end of a drill string. The BHA includes an electronic controller having a processor. The drill string includes downhole and uphole portions with the downhole portion made up of wired drill pipe and the uphole portion made up of non-wired drill pipe. The downhole portion further includes at least one sensor sub having at least one downhole sensor. The wired drill pipe provides an electronic communication link between the sensor and the processor in the bottom hole assembly.

A method for making downhole measurements includes deploying a drilling system in a subterranean wellbore. The drilling system may include a bottom hole assembly coupled to a downhole end of a drill string. The drill string includes downhole and uphole portions, the downhole portion being made up of wired drill pipe and the uphole portion being made up of non-wired drill pipe. A sensor sub including at least one sensor is deployed in the downhole portion of the drill string. A communication channel is established between the downhole sensor and a processor in the BHA using the wired drill pipe. The sensor acquires a measurement and transmits the measurement to the processor in the BHA via the wired drill pipe communication channel. The processor then processes the measurement to compute a parameter of interest which is in turn transmitted to the surface using a non-wired drill pipe communication channel such as mud pulse telemetry.

A method for downlinking data and/or a command from a surface location to a downhole processor includes providing a drilling system such as that described in the preceding paragraph. The command and/or data is transmitted from the surface to the sensor in the downhole portion of the drill string using a non-wired drill pipe communication channel, for example, employing drilling fluid pressure pulses or drill string rotation encoding. The downlinked command and/or data may then be transmitted from the sensor to the processor in the BHA using the wired drill pipe communication channel. In one embodiment, the data and/or command is decoded via a processor located proximate to the sensor. The decoded data and/or command may then be transmitted to the BHA using the wired drill pipe communication channel. In another embodiment, the signal received at the sensor is transmitted to the BHA using the wired drill pipe communication channel and then decoded using the processor in the BHA.

A method for actuating a downhole tool includes deploying a drilling system in a subterranean wellbore. The drilling system may be similar to that described above in that it includes a drill string having downhole and uphole portions, the downhole portion being made up of wired drill pipe and the uphole portion being made up of non-wired drill pipe. An actuatable downhole tool is deployed in the downhole portion. A communication channel is established between the downhole tool and a processor in the BHA using the wired drill pipe. The downhole tool may be actuated by transmitting a command from the processor to the downhole tool via the wired drill pipe.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
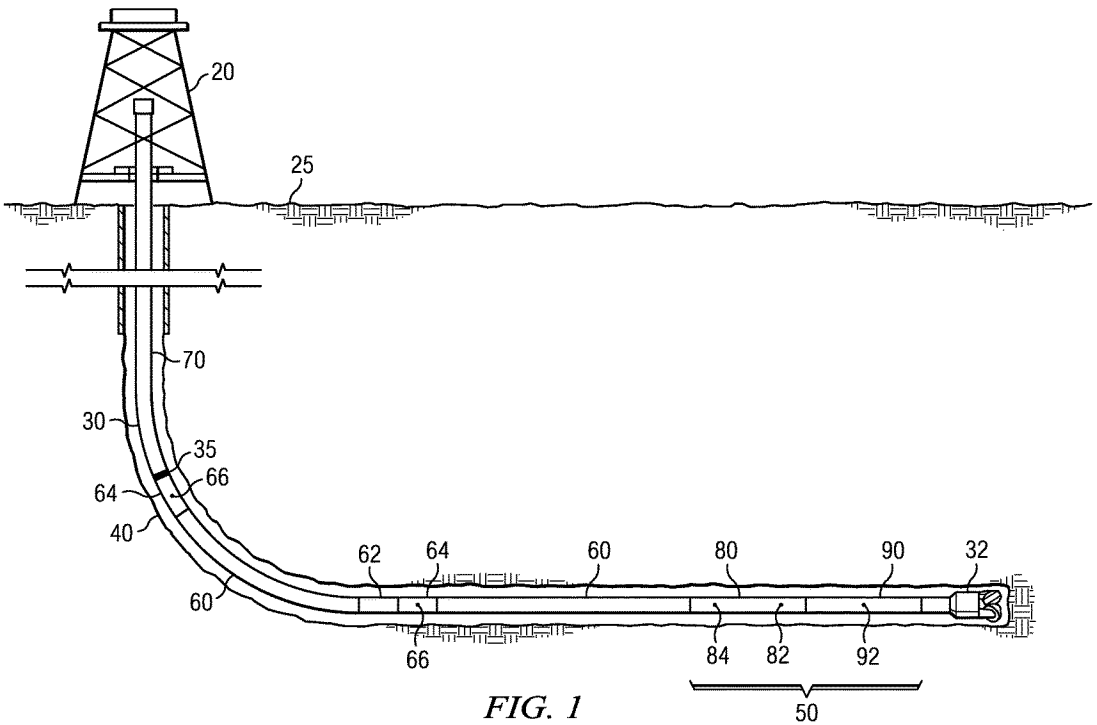
FIG. 1 depicts one example of a drilling rig on which disclosed embodiments may be utilized.

FIG. 1 depicts an example drilling rig 20 suitable for using various apparatus and method embodiments disclosed herein. The drilling rig 20 may include various surface equipment including a derrick and a hoisting apparatus for raising and lowering a drill string 30, which, as shown, extends into borehole 40 and includes a drill bit 32 deployed at the lower end of bottom hole assembly (BHA) 50. In the depicted embodiment, a lower portion 60 of the drill string 30 (from intermediate location 35 to the BHA 50) includes a plurality of joints of wired drill pipe connected end to end and therefore provides a high bandwidth digital communications channel (e.g., having a bandwidth on the order of 5 kilobits/sec) between (and optionally along) the BHA 50 and the lower portion 60 of the drill string. The wired drill pipe does not extend the whole length of the drill string 30 (i.e., from the BHA 50 to the surface), but rather extends from the BHA 50 to the intermediate location 35 in the string 30. The wired drill pipe may also be utilized in the BHA 50, for example, between measurement tools 80 and 90 and/or between measurement tool 90 and the drill bit 32. An upper portion 70 of the drill string 30 (from intermediate location 35 to the surface) is made up of conventional, non-wired drill pipe. While the disclosed embodiments are not limited in this regard the wired drill pipe generally extends from a few hundred to a few thousand feet above the drill bit, but as stated above does not extend to the surface.

With further reference to the wired drill pipe in the lower portion 60 of the drill string, it will be understood that such wire drill pipe includes one or more electrically conductive wires deployed in each length of drill pipe. Coupling devices (e.g., inductive couplers) are located at each end of the lengths of pipe so that when the pipes are threadably connected, or otherwise coupled to one another, the wired drill pipe provides a hardwired communication link spanning several lengths of pipe (i.e., across one or more joints).

The lower portion 60 of the drill string 30 may further include one or more wired drill pipe repeater subs 62 and/or sensor subs 64. These subs 62 and 64 may include substantially any suitable measurement while drilling (MWD) and/or logging while drilling (LWD) sensors 66, for example, including accelerometers, magnetometers, internal or annular pressure sensors, temperature sensors, a natural gamma ray sensor, a neutron sensor, a density sensor, an electromagnetic antenna, a resistivity sensor, an ultrasonic sensor, an audio-frequency acoustic sensor, and the like. Such sensors may also be deployed in various MWD and LWD tools (e.g., in measurement tools 80 and 90) in the BHA 50. It will be understood that the disclosed embodiments are not limited to any particular sensor deployments.

The sensor sub 64 (or subs) employing various MWD and/or LWD sensors 66 may have substantially any longitudinal spacing along the lower portion of the drill string 30. For example, the wired drill pipe may include a single sensor sub 64 located at the intermediate location 35 which may be from several hundred to several thousand feet above the drill bit 32, depending on the specific requirements of the drilling operation. The wired drill pipe may also include several sensor subs 64 having an axial spacing along the string in a range, for example, from about 100 to 1000 feet in measured depth. Moreover, the spacing between adjacent sensor subs 64 is not necessarily uniform. For example, a longitudinal spacing between first and second sensor subs is not necessarily equal to the spacing between second and third sensor subs. The disclosed embodiments are not limited in any of these regards.

In the depicted embodiment, the BHA 50 further includes an MWD tool 80 located near the drill bit 32. The MWD tool may include various wellbore surveying sensors 82, for example, including a tri-axial accelerometer set, a tri-axial magnetometer set, and/or one or more gyroscopic sensors. The MWD tool 80 may further include a telemetry device 84 such as a mudflow telemetry device and/or an electromagnetic telemetry device. As is known to those of ordinary skill in the art, a mudflow telemetry device is configured to selectively block or partially block the flow of drilling fluid through the drill string 30 thereby causing pressure changes therein. In other words, the telemetry device 84 may be configured to modulate the pressure in the drilling fluid to transmit data from the BHA 50 to a surface location. Modulated changes in pressure may be detected by a pressure transducer at the surface and processed to reconstruct the transmitted data. Modulation and demodulation of such pressure waves are described in detail in commonly assigned U.S. Pat. No. 5,375,098, which is incorporated by reference herein in its entirety. As is also known to those of ordinary skill in the art, an electromagnetic telemetry device utilizes low frequency electromagnetic waves to communicate with the surface. One example of an electromagnetic telemetry device suitable for two-way communication with the surface is disclosed in commonly assigned U.S. Pat. No. 6,727,827, which is incorporated by reference herein in its entirety.

The BHA 50 may further include an LWD tool 90 located near the drill bit 32. The LWD tool 90 may include substantially any suitable formation evaluation sensors 92 (also referred to as LWD sensors) for measuring various formation properties such as the porosity, the density, the resistivity, and the acoustic velocity of the formation. The formation evaluation sensors 92 may include, for example, a natural gamma ray sensor, a neutron sensor, a density sensor, an electromagnetic antenna, a resistivity sensor, a formation pressure sensor, an annular pressure sensor, a temperature sensor, an ultrasonic sensor, an audio-frequency acoustic sensor, a caliper sensor, and the like. The sensors may also include sensors for measuring the characteristics of the BHA such as strain gauges for measuring various directional strain components in the BHA. The disclosed embodiments are not limited to the use of any particular sensor embodiments or configurations.

It will be understood that the deployment illustrated on FIG. 1 is merely an example. BHA 50 may include substantially any suitable downhole tool components, for example, including a steering tool such as a rotary steerable tool, a mud motor, a reaming tool, and the like. The disclosed embodiments are not limited in these regards. Moreover, the disclosed methods may be used in wellbore applications other than drilling application, for example, including fluid sampling applications, well control during tripping, well maintenance, completion and production applications, and the like.

Figure 2:
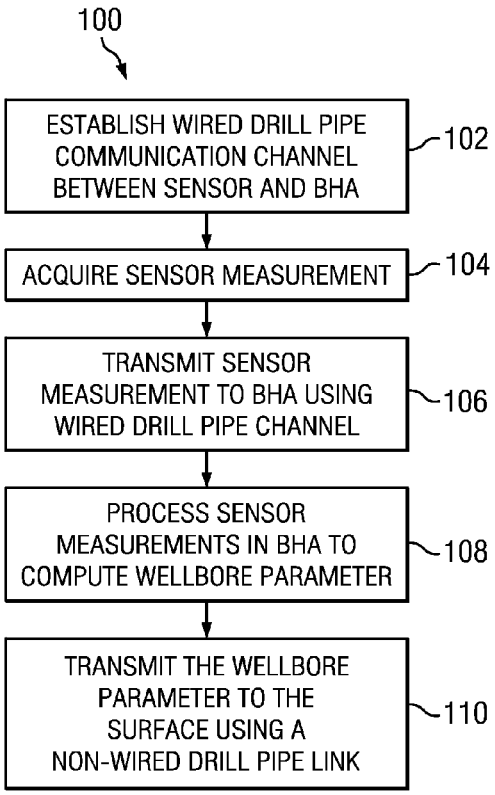
FIG. 2 depicts a flow chart of one example method embodiment.

FIG. 2 depicts a flow chart of one example method embodiment 100. Method 100 is described with continued reference to the drilling rig depicted on FIG. 1. A communication channel is established at 102 between at least one of the sensors 66 located in the wired drill pipe in the lower portion 60 of the drill string 30 and the BHA 50. The communication channel may advantageously be a two way communication channel enabling high speed bi-directional communication between a controller located in the BHA (e.g., in the MWD tool 80 or in the LWD tool 90) and the sensor 66. Sensor measurements are acquired at 104 using sensors 66 in the lower portion 60 of the drill string 30 and transmitted downhole at 106 to the BHA 50 using the wired drill pipe communication channel established in 102. The measurements may then be processed at 108 in the BHA, for example, to compute a processed parameter such as a wellbore and/or a formation parameter. This processing may be in combination with other measurements made in the BHA 50, for example, including formation evaluation sensor measurements, caliper measurements, standoff measurements, and the like. Such processing may take place, for example, at a controller located in the MWD tool 80 or the LWD tool 90. The processed parameter may then be transmitted to the surface at 110 using a non-WDP link, such as a mud pulse telemetry link or an electromagnetic telemetry link using the telemetry link 84.

It will be understood that method 100 may be utilized in making substantially any suitable downhole sensor measurements. For example, method 100 may be utilized to make deep and/or ultra-deep reading resistivity measurements having a large axial spacing between the transmitter and receiver. In such embodiments, sensor subs 64 (FIG. 1) may include electromagnetic transmitters and receivers (including transmitting antennas and receiving antennas). Electromagnetic transmitters and receivers may also be deployed in the BHA 50, for example, in LWD tool 90. Suitable electromagnetic transmitters (antennas) are disclosed, for example, in U.S. Patent Publications 2011/0074427 and 2011/0238312, each of which is incorporated by reference herein Deployment of transmitters and/or receivers in sensor sub 64 enables them to be axially spaced apart substantially any suitable distance (including up to several hundred feet or even a few thousand feet) to achieve a desired measurement depth. For example, electromagnetic transmitters may be deployed in LWD tool 90 (in proximity to a local power source) while the electromagnetic receivers may be deployed in sensor subs 64 at various suitable axial spacings from the transmitters. During an LWD operation, the electromagnetic measurements may be received (at 104 in FIG. 2) upon firing the transmitter. These measurements (e.g., the measured electromagnetic voltages) may then be transmitted downhole (at 106 in FIG. 2) in real time via the wired drill pipe. The measurements may then be processed, for example, at a processor in LWD tool 90 to obtain a formation parameter such as a formation resistivity and/or a distance to a remote bed. The formation parameter may then be transmitted to the surface using the non-WDP link.

With continued reference to FIG. 2, method 100 is, of course, not limited to the deep reading resistivity measurements described above. Substantially any suitable logging while drilling sensors may be employed to obtain deep reading and/or look-ahead (looking ahead of the bit) measurements. For example, sensor subs 64 may employ seismic sensors such that deep reading seismic measurements may be obtained at a number of locations in the BHA 50 and the lower portion 60 of the drill string. Once acquired, these measurements may be transmitted from the sensor subs 64 to the BHA 50 (as described above) via the WDP communication link. The measurements may be processed using a downhole controller, stored in downhole memory, and/or transmitted to the surface using a non-WDP communication link.

With continued reference to FIG. 2, method 100 may also be employed in making magnetic ranging measurements. Such measurements may be employed in active and/or passive magnetic ranging operations, which are commonly used determine the location of a nearby well (target well) to reduce the risk of collision, to place the well into a kill zone (e.g., near a well blow out where formation fluid is escaping to an adjacent well), and/or to drill at a predetermined spacing with respect to the nearby well (in twin well drilling operations). Passive ranging measurements may make use of remanent magnetization in the target well casing, while active ranging measurements make use of an active magnetic source (e.g., an electromagnetic) in the target well.

When making magnetic ranging measurements sensor subs 64 may employ magnetic field sensors such as a set of tri-axial magnetometers. Magnetic field measurements may be acquired while drilling (or while drilling is temporarily suspended, for example, when adding additional drill pipe to the drill string) at a number of axial locations along the BHA 50 and/or the lower portion 60 of the drill string 30. These measurements may be transmitted from the sensor subs 64 to the BHA 50 using the WDP communication link as described above. The measurements may then be processed at a processor in the BHA (e.g., in MWD tool 80 or LWD tool 90) to obtain a range and bearing (distance and direction) to the magnetic target (e.g., using triangulation techniques). Suitable processing techniques are disclosed, for example, in U.S. Pat. No. 6,985,814 which is fully incorporated herein by reference.

Method 100 may further be employed to obtain measurements of pipe stretch (which may be correlated with weight-on-bit), and/or rate of penetration of drilling. It will be understood that the term "pipe stretch" refers to a change in axial length of the drill string that may include an increase in length (pipe stretch) or a decrease in length (pipe compression). For example, measurements obtained from a number of axially spaced formation evaluation sensors (LWD sensors) may be correlated to estimate the pipe stretch and/or rate of penetration. In such embodiments, the LWD sensors are deployed in sensor subs 64 in the lower portion 60 of the drill string 30 and in the BHA 50 (e.g., in LWD tool 90). As described above with respect to FIG. 2, LWD sensor measurements may be acquired using the axially spaced LWD sensors and transmitted to the BHA 50 using the WDP communication link in the lower portion 60 of the drill string. These measurements may then be processed, e.g., via correlation routines, at a local processor (in the BHA) to compute pipe stretch and/or rate of penetration. U.S. Patent Publication 2013/0341091, which is incorporated by reference in its entirety herein, discloses a methodology for computing the rate of penetration. U.S. Patent Publication 2011/0102188, which is incorporated by reference in its entirety herein, discloses a methodology for computing the stretch or compression (i.e., the change in axial length) of a drill string during a drilling operation.

Figure 3A:
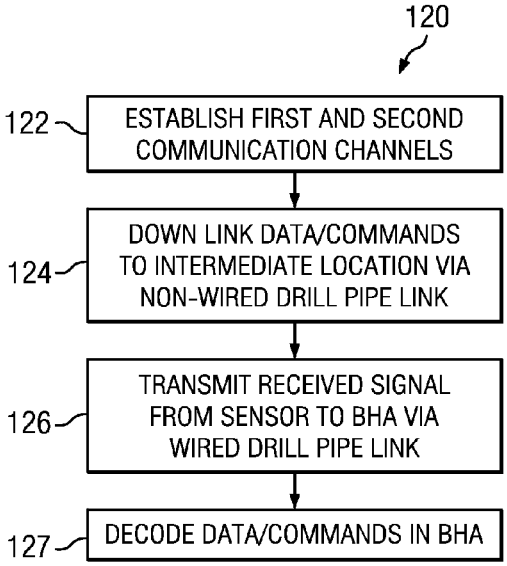
FIGS. 3A and 3B depict flow charts of other example method embodiments.
Figure 3B:
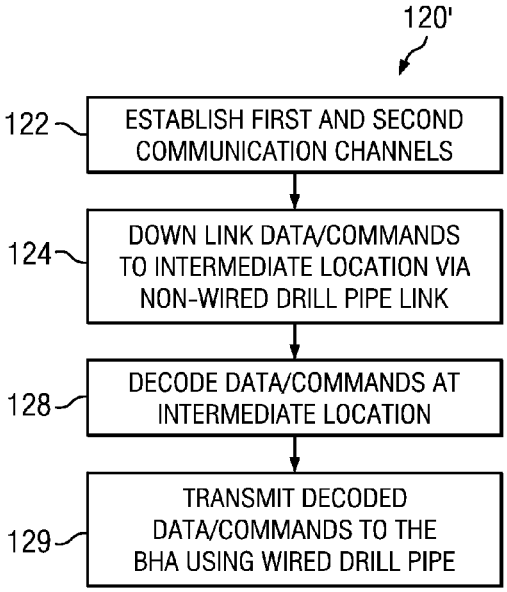

FIGS. 3A and 3B depict flow charts of method embodiments 120 and 120'. Methods 120 and 120' may be used to downlink data and/or commands from the surface to the BHA 50 and are described with continued reference to the drilling rig depicted on FIG. 1. First and second communication channels are established at 122. The first communication channel is a non-WDP link that is established between the surface and one of the sensor subs 64 in the lower portion 60 of the drill string. The first communication channel may include, for example, pressure pulses in the column of drilling fluid pumped down through the drill string. The first communication channel may additionally and/or alternatively include drill string rotation rate modulation or an electromagnetic link between the surface and the sensor sub 64. The second communication channel is a WDP link that is established between the sensor sub 64 and the BHA 50. The WDP communication channel may advantageously be a two-way communication channel enabling high speed bi-directional communication between a controller located in the BHA (e.g., in the MWD tool 80 or in the LWD tool 90) and the sensor sub 64.

With continued reference to FIGS. 3A and 3B, the data and/or commands are downlinked from the surface to the sensor sub 64 (e.g., in the form of pressure pulses in the drilling fluid) at 124. In method 120 (FIG. 3A), the received signal (e.g., a digital signal representing the received pressure pulses) may then be transmitted from the sensor sub 64 to the BHA 50 at 126 using the WDP communication link established in 122. The data and/or commands may then be decoded in the BHA 50 at 127. In method 120' (FIG. 3B), the received signal may be decoded at 128 using a processor in the sensor sub 64 and the data and/or commands may then be transmitted from the sensor sub 64 to the BHA 50 at 129 using the WDP communication link established in 122.

The data and/or commands may be downlinked from the surface to the sensors in the lower portion of the drill string, for example, in the form of pressure pulses or drilling fluid flow rate pulse in the column of drilling fluid. These pulses may be measured using one or more pressure sensors in the sensor sub 64. The pulses may be encoded and decoded using any suitable techniques. The data and/or commands may also be downlinked, for example in the form of drill string rotation rate changes which may be measured using accelerometer and/or magnetometer sets in the sensor sub 64. These rotation rate changes may be also be encoded and decoded using any suitable techniques. Suitable techniques for transmitting data and/or commands from the surface to the sensor sub 64 are disclosed in U.S. Patent Publications 2011/0286308, 2011/0286309, 2013/0220602, and 2014/0036629, each of which is incorporated by reference in its entirety herein.

It will be understood that method 120 may advantageously improve both the speed and accuracy of the downlinking communications. In particular, moving the sensors (e.g., the drilling fluid pressure sensors) away from the drill bit and other BHA components tends to reduce noise and therefore improve the speed and accuracy of the communications in the first communication channel.

Figure 4:
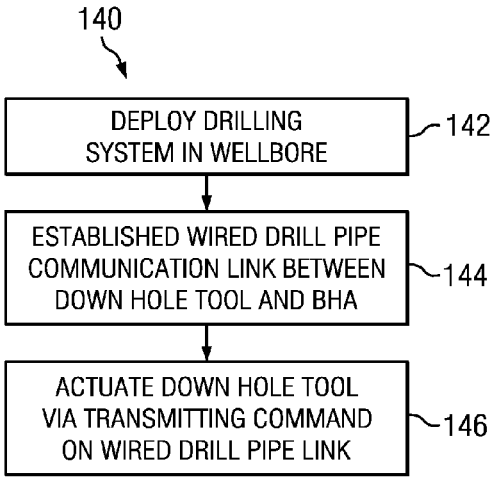
FIG. 4 depicts a flow chart of yet another example method embodiment.

FIG. 4 depicts depicts a flow chart of another example method embodiment 140. Method 140 may be used to remotely control and/or actuate a downhole tool based on two-way communication between the tool and the BHA and is described with continued reference to the drilling rig depicted on FIG. 1. At 142 a drilling assembly is deployed in a subterranean wellbore. The drilling assembly includes a BHA deployed at the downhole end of a drill string including upper and lower portions 60 and 70 as described in FIG. 1. The lower portion of the drill string 60 (made up of wired drill pipe as described above) further includes an actuatable downhole tool (not shown on FIG. 1) such as a reamer, an adjustable stabilizer, a choke, a valve, a sensor, and the like. A two-way communication link is established between the downhole tool and the controller in the BHA via the wired drill pipe at 144. The downhole tool is then actuated at 146 via transmitting a command from the BHA to the tool via the wired drill pipe communication link established in 144.

With continued reference to FIG. 4, the downhole tool may include, for example, a reamer having retractable and extendable blades. As is known to those of ordinary skill in the art, reamer blades are generally retracted while drilling (so as not to engage the borehole wall). To initiate a reaming operation a command may be downlinked to a controller in the BHA 50, for example, using method 120 or 120'. The controller may then transmit the command via the wired drill pipe communications channel to the reamer to extend the reamer blades. After completion of the reaming operation, a similar command may be downlinked to the BHA and transmitted to the reamer to retract the reamer blades. Similar methodology may likewise be utilized, for example, to open and close valves or vents, to activate and deactivate sensors, and/or to adjust the gauge of an adjustable stabilizer.

It will be understood that method 140 is not limited to downlinking a command as described in the above example. Such control may also utilize a "smart" system. For example, the controller may be configured to automatically actuate the downhole tool when certain drilling conditions have been met. For example, the reamer blades may be extended when drilling a borehole having a predetermined calliper or dogleg severity. Likewise, sensors may be activated upon entering a predetermined formation (which may be established based upon real time MWD and/or LWD data). The disclosed embodiments are not limited in any of these regards.

A bottom hole assembly employing wired drill pipe and certain advantages thereof have been described in detail, it should be understood that various changes, substitutions and alternations can be made herein without departing from the spirit and scope of the disclosure as defined by the appended claims.

What is claimed is:

1. A system for drilling a subterranean wellbore, the system comprising:

a bottom hole assembly coupled to a downhole end of a drill string, the bottom hole assembly including an electronic controller having a processor, the drill string including downhole and uphole portions, the downhole portion made up of wired drill pipe and the uphole portion made up of non-wired drill pipe, the downhole portion including a sensor sub having at least one downhole sensor, the wired drill pipe providing an electronic communication link between the sensor and the processor in the bottom hole assembly, the downhole portion comprising a telemetry module for communication to the surface, and the at least one downhole sensor comprising an electromagnetic resistivity sensor, an electromagnetic ranging sensor, a plurality of seismic sensors spaced along the downhole portion of the drill string, a magnetic ranging sensor, or a plurality of sensors to measure pipe stretch or rate of penetration.

2. The system of claim 1, wherein the bottom hole assembly further comprises a measurement while drilling tool including a mud pulse telemetry module.

3. The system of claim 1, wherein the downhole sensor comprises at least one of accelerometers, magnetometers, internal or annular pressure sensors, temperature sensors, a natural gamma ray sensor, a neutron sensor, a density sensor, an electromagnetic antenna, a resistivity sensor, an ultrasonic sensor, and an audio-frequency acoustic sensor.

4. A method for making downhole measurements, the method comprising:

(a) deploying a drilling system in a subterranean wellbore, the drilling system including a bottom hole assembly coupled to a downhole end of a drill string, the drill string including downhole and uphole portions, the downhole portion made up of wired drill pipe and the uphole portion made up of non-wired drill pipe, the downhole portion including a sensor sub having at least one downhole sensor and a telemetry system for communication to the surface, the at least one downhole sensor comprising an electromagnetic resistivity sensor, an electromagnetic ranging sensor, a plurality of seismic sensors spaced along the downhole portion of the drill string, a magnetic ranging sensor, or a plurality of sensors to measure pipe stretch or rate of penetration;

(b) establishing a communication channel between the downhole sensor and a processor in the bottom hole assembly using the wired drill pipe;

(c) causing the downhole sensor to acquire a sensor measurement;

(d) transmitting the sensor measurement from the downhole sensor to the processor via the communication channel established in (b);

(e) causing the processor to process the sensor measurement to compute a parameter; and (f) transmitting the parameter computed in (e) to the surface using the telemetry system for communication to the surface, the telemetry system comprising a non-wired drill pipe communication channel.

5. The method of claim 4, wherein the non-wired drill pipe communication channel is a mud pulse telemetry channel or an electromagnetic telemetry channel.

6. The method of claim 4, wherein:

the downhole sensor comprises an electromagnetic receiving antenna;

the sensor measurement comprises a voltage measurement; and the processor computes at least one of a formation resistivity or a distance to a remote bed in (e).

7. The method of claim 4, wherein the downhole sensor comprises a plurality of seismic sensors spaced along the downhole portion of the drill string.

8. The method of claim 4, wherein:

the downhole sensor comprises a magnetic field sensor;

the sensor measurement comprises a magnetic field measurement; and the processor computes at least one of a distance and a direction to a magnetic target in (e).

9. The method of claim 4, wherein:

the downhole sensor comprises a plurality of logging while drilling sensors spaced along the downhole portion of the drill string;

the sensor measurement comprises logging while drilling measurements; and the processor computes at least one of a pipe stretch and a rate of penetration of drilling via correlating the logging while drilling measurements in (e).

10. A method for actuating a downhole tool, the method comprising:

(a) deploying a drilling system in a subterranean wellbore, the drilling system including a bottom hole assembly coupled to a downhole end of a drill string, the drill string including downhole and uphole portions, the downhole portion made up of wired drill pipe and the uphole portion made up of non-wired drill pipe, the downhole portion including an actuatable downhole tool deployed therein, the downhole tool comprising a reamer, an adjustable stabilizer, a choke, or a valve;

(b) establishing a communication channel between the downhole tool and a processor in the bottom hole assembly using the wired drill pipe; and (c) actuating the downhole tool via transmitting a command from the processor to the downhole tool via the communication channel established in (b).

11. The method of claim 10, wherein (c) further comprises:

(i) downlinking a command to actuate the downhole tool from a surface location to the processor; and (ii) transmitting the command from the processor to the downhole tool via the communication channel established in (b).

* * * * *